US006435483B1

(12) United States Patent
Popov

(10) Patent No.: US 6,435,483 B1
(45) Date of Patent: Aug. 20, 2002

(54) GAS-LIQUID EJECTOR

(75) Inventor: Serguei A. Popov, 4615 Post Oak Pl., Suite 140, Houston, TX (US) 77027

(73) Assignees: Evgueni D. Petroukhine, Limassol (CY); Serguei A. Popov, Budapest (HU)

( * ) Notice: Subject to any disclaimer, the term of this patent is extended or adjusted under 35 U.S.C. 154(b) by 0 days.

(21) Appl. No.: 09/445,538

(22) PCT Filed: Mar. 2, 1999

(86) PCT No.: PCT/IB99/00356

§ 371 (c)(1),
(2), (4) Date: Apr. 6, 2001

(87) PCT Pub. No.: WO99/45277

PCT Pub. Date: Sep. 10, 1999

(30) Foreign Application Priority Data

Mar. 2, 1998 (RU) ..... 98103483

(51) Int. Cl.[7] ..... B01F 3/04
(52) U.S. Cl. ..... 261/76
(58) Field of Search ..... 261/76, DIG. 75; 239/338, 428.5; 417/151, 158

(56) References Cited

U.S. PATENT DOCUMENTS

| | | | | |
|---|---|---|---|---|
| 2,382,391 A | * | 8/1945 | Berman | |
| 2,582,069 A | * | 1/1952 | Rose | |
| 5,628,623 A | | 5/1997 | Skaggs | |
| 6,199,834 B1 | * | 3/2001 | Popov et al. | 261/76 |
| 6,220,578 B1 | * | 4/2001 | Popov | 261/76 |
| 6,224,042 B1 | * | 5/2001 | Popov | 261/76 |
| 6,261,067 B1 | * | 7/2001 | Popov | 417/198 |

FOREIGN PATENT DOCUMENTS

| | | | |
|---|---|---|---|
| SU | 112242 | | 12/1958 |
| SU | 1054580 | | 11/1983 |
| SU | 1291729 A1 | * | 2/1987 |
| SU | 1291730 | | 2/1987 |
| WO | 99/31392 | * | 6/1999 |

OTHER PUBLICATIONS

Sokolov E.Y. and Zinger N.M., "Jet apparatuses" book, 1989, USSR, Moscow, "Energoatomizdat" Publishing house, pp. 94, 95, 213, 214.

* cited by examiner

*Primary Examiner*—C. Scott Bushey
(74) *Attorney, Agent, or Firm*—Mark A. Oathout

(57) ABSTRACT

The present invention pertains to the field of jet technology and more essentially to a liquid-gas ejector having a nozzle and a mixing chamber. The area of the minimal cross-section of the mixing chamber of the liquid-gas ejector is determined from the following formula:

$$F = kQ\sqrt{\frac{Pc * g}{\gamma}}$$

where F—area of the minimal cross-section of the mixing chamber; k—design factor; Q—volumetric flow rate of a liquid through the nozzle; g—acceleration of gravity; y—density of the liquid fed into the nozzle; $P_c$—liquid pressure at the nozzle inlet; and where the k factor has a value ranging from 1.6 to 60 when the ratio of the liquid pressure at the nozzle inlet to the pressure of a liquid-gas mixture at the mixing chamber outlet is from 1.4 to 25 and the k factor has a value ranging from 60 to 2200 when the ratio of the liquid pressure at the nozzle inlet to the pressure of a liquid-gas mixture at the mixing chamber outlet is from 25 to 5000. A liquid-gas ejector having an area of the minimal cross-section of its mixing chamber calculated according to the above-mentioned formula exhibits an improved efficiency factor.

1 Claim, 1 Drawing Sheet

GAS-LIQUID EJECTOR

BACKGROUND

The present invention pertains to the field of jet technology, primarily to liquid-gas ejectors for producing a vacuum during evacuation of various gaseous and gas-vapor mediums.

An ejector is known, which includes a steam nozzle, a mixing chamber converging in the flow direction and having a throttle, and a diffuser (see, Sokolov E. Y. & Zinger N. M., "Jet Apparatuses, Moscow", "Energoatomizdat" Publishing house, 1989, pages 94–95).

Ejectors of this type are widely adopted for evacuation of gas-vapor mediums in the condenser units of steam turbines and in steam-ejector refrigeration units.

However the efficiency of these ejectors is relatively low in cases where the evacuated gaseous mediums contain a lot of condensable components.

The closest analogue of the ejector described in the invention is a liquid-gas ejector having a liquid nozzle and a mixing chamber (see, Sokolov E. Y. & Zinger N. M., "Jet Apparatuses", Moscow, "Energoatomizdat" Publishing house, 1989, pages 213–214).

Such ejectors are used in power engineering as air-ejector devices of condenser units, in water deaeration vacuum systems, and for vacuumization of various reservoirs. One characteristic of the given ejectors is the fact that during evacuation of a steam-air mixture the steam, contained in the mixture, is condensed and therefore a water-air mixture is compressed in the mixing chamber (if water is used as the liquid medium fed into the nozzle).

But the operational effectiveness of these ejectors is not high enough. A relatively low performance of the ejectors is often caused by nonoptimal correlation between the regime of nozzle liquid flow and the minimal sectional area of the mixing chamber.

SUMMARY OF THE INVENTION

The objective of the present invention is to increase the efficiency factor of a liquid-gas ejector due to optimization of the correlation between the regime of nozzle liquid flow and the minimal sectional area of the mixing chamber.

The stated objective is achieved as follows: the minimal cross-sectional area of a mixing chamber of a liquid-gas ejector, having a nozzle and the mixing chamber, is determined from the following formula:

$$F = kQ\sqrt{\frac{Pc*g}{\gamma}}$$

where

F—area of the minimal cross-section of the mixing chamber;

k—design factor;

Q—volumetric flow rate of a liquid through the nozzle;

g—acceleration of gravity;

γ—density of the liquid fed into the nozzle;

$P_c$—liquid pressure at the nozzle inlet;

The k factor has a value ranging from 1.6 to 60 when the ratio of the liquid pressure at the nozzle inlet to the pressure of a mixture of mediums at the mixing chamber outlet ranges from 1.4 to 25. The k factor has a value ranging from 60 to 2200 when the ratio of the liquid pressure at the nozzle inlet to the pressure of a liquid-gas mixture at the mixing chamber outlet ranges from 25 to 5000.

Experimental research has shown, that correlation between the areas of minimal cross-sections of the mixing chamber and the nozzle does not give firm confidence for an optimal operational mode of the liquid-gas ejector, because the correlation does not take into account the energy impulse transferred from the high-speed liquid flow to the evacuated gaseous medium. It is borne in mind that the liquid flow through the same nozzle may vary and, consequently, such flow parameters as the degree of the liquid flow dispersion behind the nozzle outflow face and the flow velocity at the nozzle outflow face may be different. In its turn, dimensions of the mixing chamber, and above all an area of its minimal cross-section, depend on the mentioned flow parameters. The experiments helped to discover a dependence between the area of the minimal cross-section of the mixing chamber and the major operational parameters of the ejector nozzle—liquid pressure at the nozzle inlet and liquid flow rate through the nozzle. In addition, a design factor was discovered, whose value, in its turn, depends on the ratio between the liquid pressure at the nozzle inlet and pressure of a liquid-gas mixture at the mixing chamber outlet. So, the following dependence between the stated above parameters was obtained:

$$F = kQ\sqrt{\frac{Pc*g}{\gamma}}$$

where

F—area of the minimal cross-section of the mixing chamber;

k—design factor;

Q—volumetric flow rate of a liquid through the nozzle;

g—acceleration of gravity;

γ—density of the liquid fed into the nozzle;

$P_c$—liquid pressure at the nozzle inlet;

As for the design factor k its value amounts from 1.6 to 60 when the ratio of the liquid pressure at the nozzle inlet to the pressure of mediums' mixture at the mixing chamber outlet is from 1.4 to 25 and the k factor ranges from 60 to 2200 when the ratio of the liquid pressure at the nozzle inlet to the pressure of mediums' mixture at the mixing chamber outlet is from 25 to 5000.

DETAILED DESCRIPTION

Figure 1:
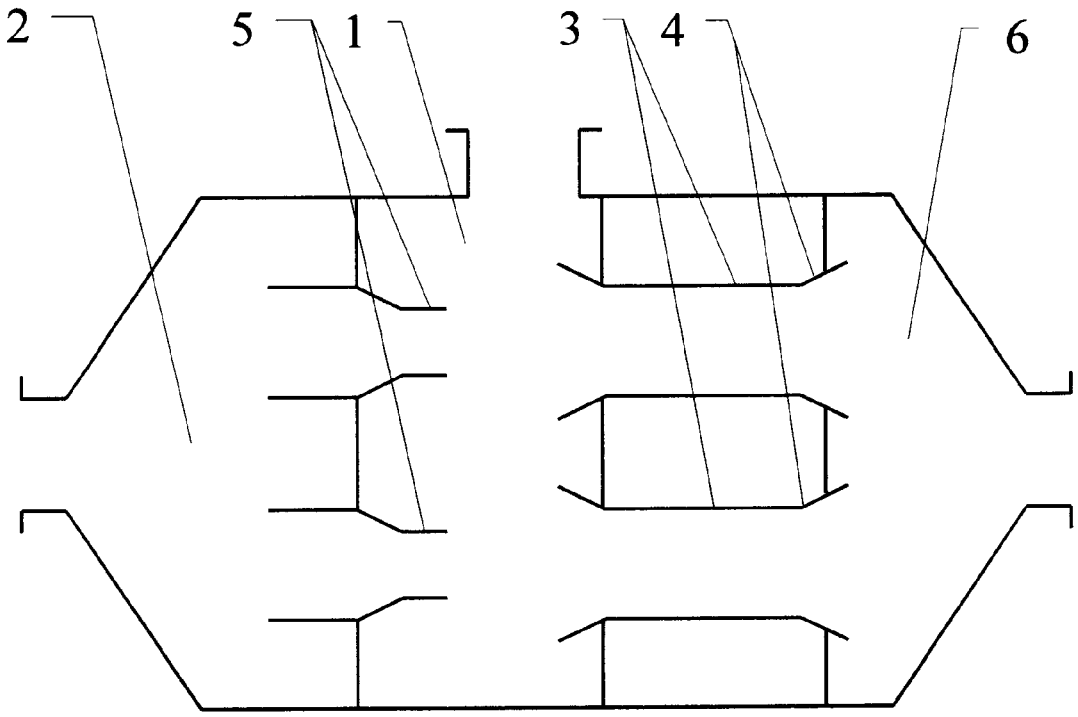
FIG. 1 represents a schematic diagram of the described liquid-gas ejector.

The liquid-gas ejector has a receiving chamber 1, a distribution chamber 2, mixing chambers 3 with diffusers 4, active nozzles 5 and a discharge chamber 6.

The area of the minimal cross-section of each mixing chamber 3 is determined from the formula $$F = kQ\sqrt{\frac{Pc*g}{\gamma}}$$

where

F—area of the minimal cross-section of the mixing chamber 3;

k—design factor;

Q—volumetric flow rate of a liquid through the nozzle 5;

g—acceleration of gravity;

γ—density of the liquid fed into the nozzle 5;

$P_c$—liquid pressure at the nozzle's 5 inlet.

The value of the k factor ranges from 1.6 to 60 when the ratio of the liquid pressure $P_c$ at the inlet of the nozzle 5 to the pressure of a liquid-gas mixture at the outlet of the mixing chamber 3 is from 1.4 to 25. The value of the k factor ranges from 60 to 2200 when the ratio of the liquid pressure $P_c$ at the inlet of the nozzle 5 to the pressure of a liquid-gas mixture at the outlet of the mixing chamber 3 is from 25 to 5000.

It is necessary to note that the drawing and its description represent a multi-nozzle ejector. However, the given formula is also valid for single-nozzle liquid-gas ejectors. Additionally, the drawing represents such a design of the ejector, wherein the mixing chambers 3 are followed by the diffusers 4, but the formula is also true for the ejectors, which do not have diffusers after the mixing chambers 3.

The liquid-gas ejector operates as follows.

A liquid medium under $P_c$ pressure is fed into the nozzles 5. Flowing out from the nozzles 5 with the adjusted flow rate Q, the liquid entrains an evacuated gaseous medium into the mixing chambers 3, mixes with it and compresses the gaseous medium at the same time. A gas-liquid mixture from the mixing chambers 3 flows into the diffusers 4 (if they are installed) and then passes to its destination. Industrial, Applicability: The described liquid-gas ejector can be applied in chemical, petrochemical and other industries, where evacuation of gaseous mediums is required.

What is claimed is:

1. A liquid-gas ejector, comprising a nozzle and a mixing chamber, wherein the area of the minimal cross-section of the mixing chamber is determined from the following formula:

$$F = kQ\sqrt{\frac{Pc * g}{\gamma}}$$

where

F—the area of the minimal cross-section of the mixing chamber;

k—design factor;

Q—volumetric flow rate of a liquid through the nozzle;

g—acceleration of gravity;

γ—density of the liquid fed into the nozzle;

$P_c$—liquid pressure at the nozzle inlet;

and wherein the k factor has a value ranging from 1.6 to 60 when the ratio of the liquid pressure at the nozzle inlet to the pressure of a liquid-gas mixture at the mixing chamber outlet ranges from 1.4 to 25 and the k factor has the value ranging from 60 to 2200 when the ratio of the liquid pressure at the nozzle inlet to the pressure of the liquid-gas mixture at the mixing chamber outlet ranges from 25 to5000.

* * * * *